US006364605B1

(12) United States Patent
Lutes

(10) Patent No.: US 6,364,605 B1
(45) Date of Patent: Apr. 2, 2002

(54) REGENERATIVE TURBINE PUMP

(75) Inventor: Paul J. Lutes, Edmond, OK (US)

(73) Assignee: Corken, Inc., Oklahoma City, OK (US)

( * ) Notice: Subject to any disclaimer, the term of this patent is extended or adjusted under 35 U.S.C. 154(b) by 0 days.

(21) Appl. No.: 09/648,682

(22) Filed: Aug. 25, 2000

(51) Int. Cl.[7] ..... F01D 11/00
(52) U.S. Cl. ..... 415/111; 415/55.1; 277/370
(58) Field of Search ..... 415/113, 55.1, 415/55.2, 55.3, 55.4, 55.5, 111, 170.1, 174.2, 230, 231; 277/370, 372, 373, 371, 345, 346, 347, 348

(56) References Cited

U.S. PATENT DOCUMENTS 3,168,871 A * 2/1965 Sieghartner ..... 103/108
3,918,831 A * 11/1975 Grennan ..... 415/131
4,247,263 A * 1/1981 Pech et al. ..... 417/203
4,586,872 A * 5/1986 Corzilius et al. ..... 415/219 C
5,944,482 A * 8/1999 Cronin ..... 415/111

* cited by examiner

*Primary Examiner*—Edward K. Look
*Assistant Examiner*—James M McAleenan
(74) *Attorney, Agent, or Firm*—Crowe & Dunlevy

(57) ABSTRACT

A rotating impeller pump having an axial face seal carried on a shaft of the impeller positioned inboard of the impeller has a drive mechanism for the shaft carried seal face commonly driven through a keyway in the shaft which drives the impeller such that both the impeller and shaft seal can be easily removed from the shaft.

4 Claims, 2 Drawing Sheets

REGENERATIVE TURBINE PUMP

BACKGROUND OF THE INVENTION

1. Field of the Invention

The present invention relates to pumps and particularly to rotating pumps employing axial shaft seals.

2. Description of the Related Art

Impeller type pumps such as regenerative turbine pumps are shaft driven and normally employ housing shaft seals. A typical seal includes a housing carried stationary seal member and a shaft carried rotating seal member with the seal members axially urged into face to face abutment. Since the seal is a wear item, it is necessary to provide access to the seal for disassemblability of the seal and replaceability of the seal or components thereof. This normally involves disassembly of a major portion of the pump to provide access to the seal components.

Difficulty in disassembly is compounded by the fact that the rotating portion of the seal must be fixed to the shaft for rotation therewith and axially positioned with respect to the stationary seal portion.

Since access to and ease of disassemblability and removability of the shaft seal, the principal wear component of the pump, is a critical factor in pump maintenance, improvement of ease of repair and replacement represents a significant advance in pump design.

SUMMARY OF THE INVENTION

This invention provides improved assembly, disassembly and repair of pumps and in particular regenerative turbine pumps by providing a pump assembly which includes a housing member defining a turbine chamber and a seal chamber with the turbine chamber closed by an end cap. The shaft extends from a bearing mount through the seal chamber and into an internal recess in the end cap. The shaft passes through a stationary seal face at the entrance to the seal chamber. A rotating seal assembly is positioned on the shaft intermediate the stationary seal member and the impeller and is commonly keyed to the shaft in a key groove in the shaft which receives a locking key positioning the impeller. A snap-ring received in a groove in the shaft provides axial positioning of the rotating seal assembly. By providing a common rotational mount for the impeller and the rotating shaft assembly utilizing a single key groove in the shaft, ease of access, disassembly and removability of the shaft seal is provided. Upon removal of the end cap, the impeller can be slid off the shaft through the open end thus giving direct access to the snap-ring. Because the key groove is common for both the mount of the impeller and the rotating shaft seal, upon removal of the impeller key the seal assembly can be slid off the shaft for replacement. Removal of the rotating shaft assembly provides direct access to the stationary seal ring.

In an embodiment of the invention, an impeller pump is provided with a drive shaft having a key groove therein and a rotating shaft seal assembly carried by the shaft is rotationally fixed to the shaft via the key groove which also rotationally fixes the impeller.

In an embodiment of the invention, a pump housing is provided having an impeller wheel pumping housing section which includes a seal opening for a shaft seal with a common shaft extending into the seal opening through a stationary portion of a shaft seal, the shaft having a key groove, the rotating assembly portion of the shaft seal being carried on the shaft and keyed to the shaft in the key groove, the impeller being carried on the shaft and keyed to the shaft in the same key groove as the rotating seal assembly.

In a further embodiment of the invention, a regenerative turbine pump is provided having a multi-part housing including a bearing housing section, an end-cap section, and a seal and pumping chamber positioned between the bearing section and the end-cap section. A common shaft extends through the bearing section, the seal section and into a portion of the end-cap and is provided with a key groove. An impeller wheel is mounted on the shaft and keyed to the shaft via the key groove. A seal assembly is mounted in the seal area including a rotatable section mounted to the shaft and keyed thereto by the same key groove. A stationary shaft seal portion is carried by the intermediate housing at the juncture with the bearing housing portion. All portions of the shaft seal are accessible upon removal of the end cap, the impeller and the impeller shaft key.

Other features and objects of the invention will be apparent to those skilled in the art from the following description of the preferred embodiment.

DETAILED DESCRIPTION OF THE PREFERRED EMBODIMENTS

Figure 1:
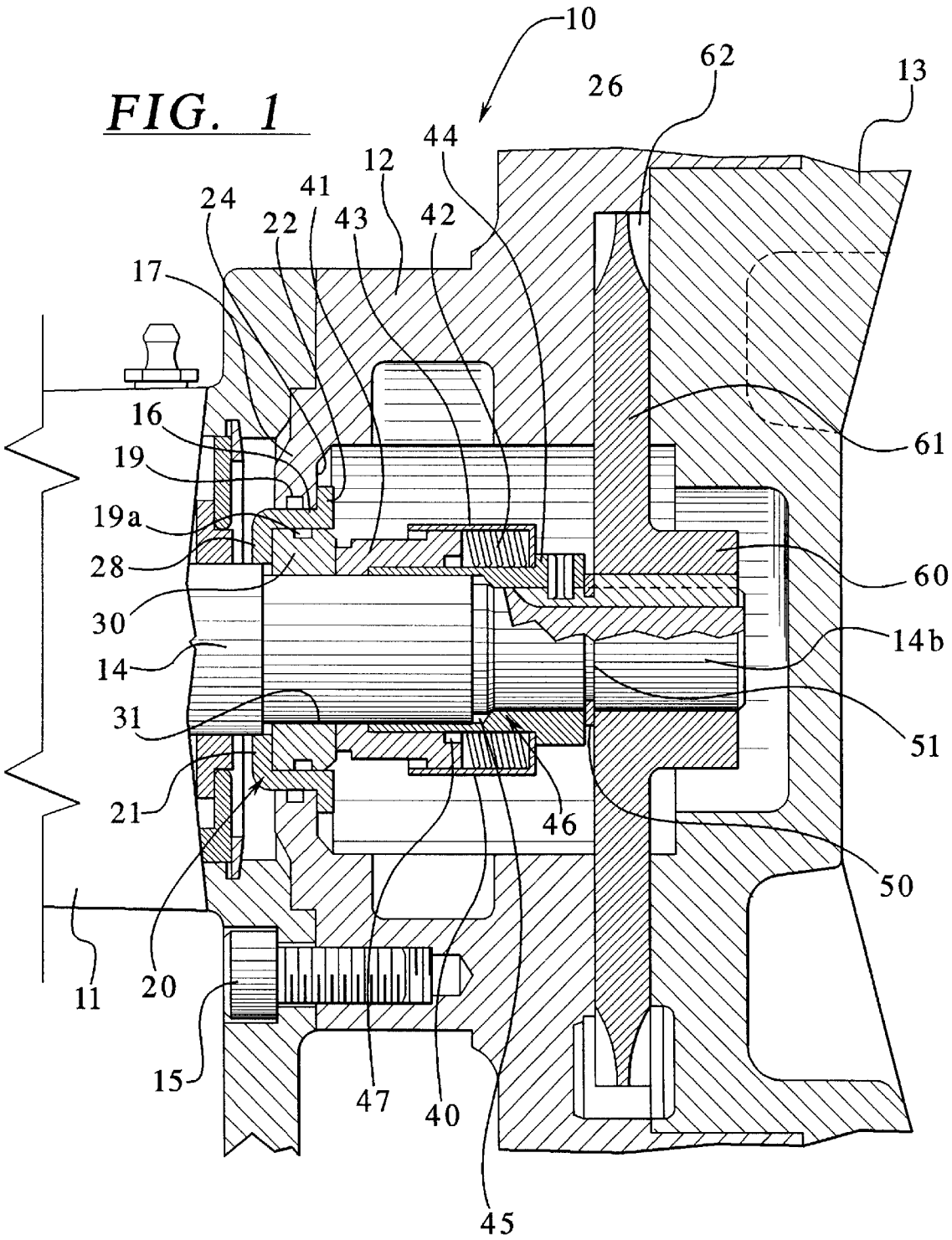
FIG. 1 is a fragmentary cross sectional view of a regenerative turbine pump according to the present invention.

FIG. 1 illustrates a portion of a turbine pump 10 including a bearing assembly housing 11, an intermediate housing 12 and an end-cap housing portion 13. The bearing assembly housing contains normal shaft bearings supporting a shaft 14. The bearing housing 11 may be fixed to the intermediate housing 12 by devices such as bolts 15. As is well known to those skilled in the art, seal gaskets, stationary o-ring seals or the like may be utilized to seal the housing sections together. The intermediate housing 12 includes an axial end opening 16 defined in an end wall 17. The opening 16 may be provided with a circumferential seal o-ring groove 19. The shaft 14 extends through the opening 16 through the stationary portion 20 of a shaft seal. The stationary portion may include a seal housing 21 press fitted into the opening 16 having an internal out-turned flange 22 partially overlying an internal radial wall 24 of the housing 12 which extends radially outwardly from the opening 16 and defines a first end of a pump assembly chamber 26 within the intermediate housing 12. An inturned flange portion 28 of the seal housing 21 at the axial end of the housing 21 opposite the outturned flange 22 forms an axial stop for a stationary seal ring 30. Again, an o-ring groove 19*a* may be provided between the seal sleeve and the stationary seal ring. The stationary seal ring receives the shaft 14, preferably with a very slight inter diameter clearance between the inter diameter of the stationary seal ring 31 and the outer diameter of the shaft.

A rotating seal assembly 40 is carried by the shaft in the seal chamber 26 and includes a rotating face seal 41 which is biased against the stationary face seal 30 by biasing members such as springs 42 received in a housing 43 which in turn is non-rotatably carried by a shaft collar portion 44 of a rotating seal sleeve 46. The shaft sleeve 46 extends along the shaft and may include secondary seal areas such as at 45 for receipt of secondary seals such as o-ring seals. Addition secondary seals may be provided between the rotating seal face member 41 and the seal sleeve 46 such as at o-ring space 47.

The rotating seal assembly is axially fixed to the shaft via a snap-ring 50 received in a snap-ring groove 51 in the shaft. It will be seen that the sleeve 46 is therefore axially held between the snap ring 50 and the trapped o-ring at 47. A free end section 14*b* of shaft 14 extends beyond the groove 51 and receives the inner hub 60 of an impeller 61. The impeller 61 is received in an impeller chamber or pump chamber 62 which is may be formed in an axial end counterbore of the intermediate housing. It will of course be understood by those skilled in the art that the pumping chamber 62 may likewise be formed in the opposite axial end of the end cap 13 or be partially formed in each. Moreover, the counterbore may be provided with wear plates, surface treatments or the like. The impeller illustrated is of the type known as a floating impeller and relative axial movement is permitted between the shaft and the impeller.

Figure 2:
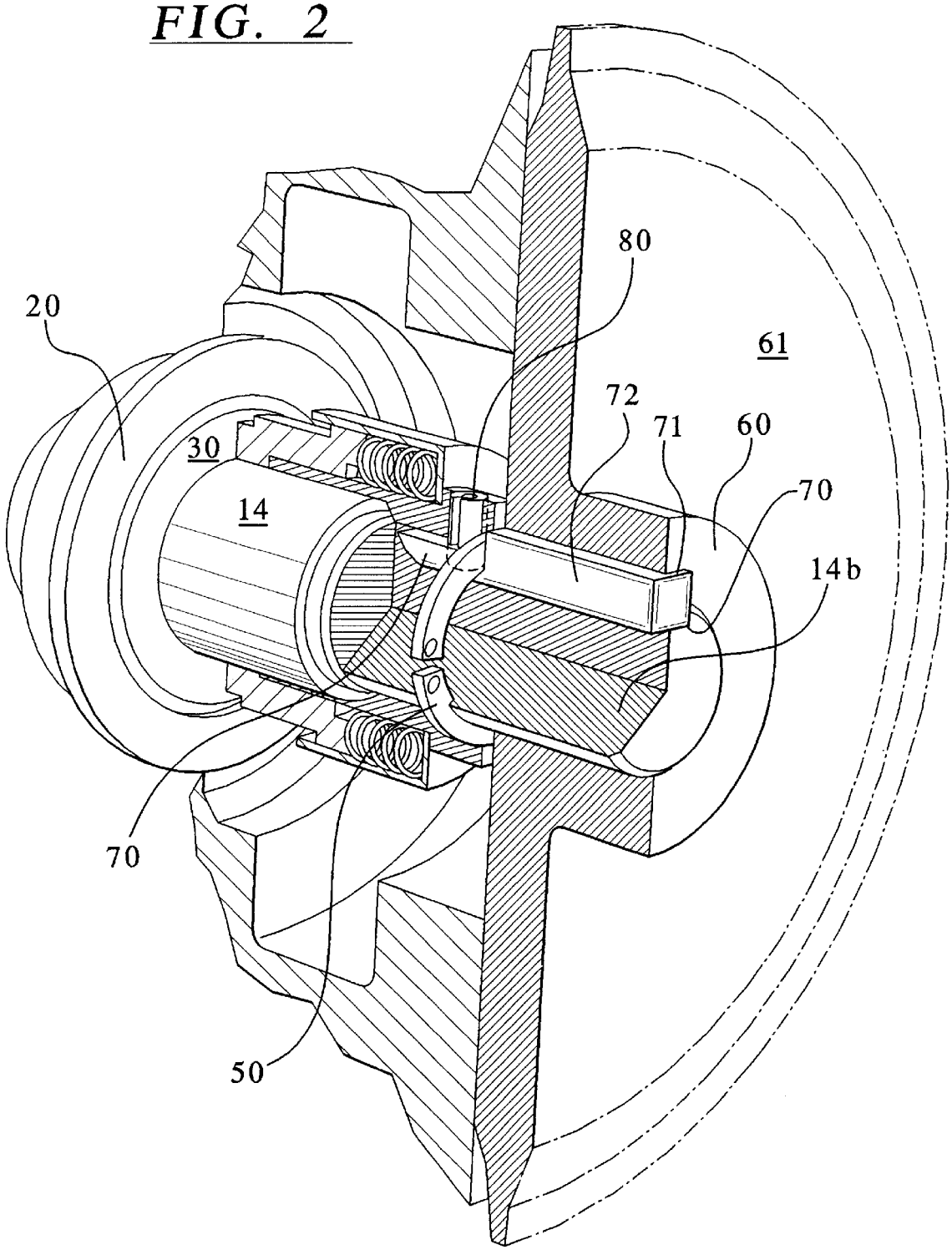
FIG. 2 is a fragmentary perspective sectional view, with parts broken away of a the impeller-shaft-seal assembly and mounting.

As best shown in FIG. 2, the end section 14*b* of the shaft 14 is provided with an axial key groove 70. The hub 60 of the impeller is provided with a mating key groove 71. A key 72 received in the key groove thus locks the impeller rotationally to the shaft. The key groove 70 extends axially of the shaft section 14*b* into the area of the shaft within the seal chamber 26 radially inwardly of portions of the seal sleeve. A drive pin 80 is received through the seal sleeve and extends into the key groove 70 to rotationally lock the rotating seal assembly 40 to the shaft 14.

The end cap 13 is affixed to the intermediate housing 12 and is easily removable therefrom, such as by removing fixture bolts, clamp collar or like attachment devices. Upon removal of the end cap 13, the impeller 61 can be removed from the key and shaft, the key can be removed from the key groove and the snap-ring 50 released from the groove 51. It can therefore be seen that the entirety of the rotating seal assembly can now be easily removed along the shaft giving access to the stationary seal face 30 and its mounting sleeve 20. In this manner the entirety of the seal assembly may be removed, replaced or repaired. By providing a relatively large diameter seal chamber 26, simple access to all components of the seal assembly is provided.

Although I have described my invention with respect to a single disclosed preferred embodiment, it will be readily understood by those of ordinary skill in the art that this invention is equally useful in other embodiments.

I claim as my invention:

1. A turbine pump comprising a pump housing including a pump chamber at a first end of the housing having an impeller pump received therein, a shaft access opening that at the opposite end of the housing, a drive shaft extending through the housing, an axial face seal assembly received around the shaft having a stationary portion carried by the housing adjacent the shaft opening and a rotating portion carried by the shaft intermediate the stationary portion and the impeller, the shaft having a keyway, the rotating seal portion having a radial extension extending into the keyway, the impeller having a mating keyway and a key received in the keyway and mating keyway rotatably locking the impeller to the shaft whereby both the rotating seal assembly and the impeller are rotationally fixed to the shaft through a common keyway.

2. The pump of claim 1 wherein the shaft is provided with a snap-ring groove intermediate the rotating seal on the impeller, the groove receiving a snap-ring projecting radially outwardly from the shaft and abutting an end of the rotating seal assembly.

3. The pump of claim 2 wherein the rotating seal assembly includes an axially movable face portion mounted to an axially stationary sleeve portion received around the shaft, the sleeve portion being keyed to the shaft at the keyway, and springs biasing the axially movable face seal portion toward the stationary seal and maintaining the collar against the snap-ring.

4. A housing having an opening therein defining a turbine chamber and a seal chamber open to the turbine chamber, a shaft entrance at one end of the seal chamber, an end-cap at an end of the housing opposite the shaft opening, a shaft extending through said opening, through said seal chamber and into said turbine chamber, a turbine received around the shaft and positioned in the turbine chamber, a shaft seal received in the seal chamber effective to provide a seal between the housing and the shaft adjacent the shaft opening, the shaft having a keyway-key connection to the turbine, the seal assembly having a rotating portion rotationally fixed to the shaft at the keyway.

* * * * *

UNITED STATES PATENT AND TRADEMARK OFFICE

CERTIFICATE OF CORRECTION

PATENT NO. : 6,364,605 B1
DATED : April 2, 2002
INVENTOR(S) : Lutes

It is certified that error appears in the above-identified patent and that said Letters Patent is hereby corrected as shown below:

Title page,
Item [*] Notice, delete the phrase "by 0 days" and insert -- by 27 days --

Signed and Sealed this

Eleventh Day of May, 2004

JON W. DUDAS
*Acting Director of the United States Patent and Trademark Office*